US008376257B2

(12) United States Patent
Fan

(10) Patent No.: US 8,376,257 B2
(45) Date of Patent: Feb. 19, 2013

(54) VIBRATING CONE CRUSHER

(76) Inventor: Kung-Chi Fan, Pingzhen (TW)

( * ) Notice: Subject to any disclaimer, the term of this patent is extended or adjusted under 35 U.S.C. 154(b) by 220 days.

(21) Appl. No.: 12/979,271

(22) Filed: Dec. 27, 2010

(65) Prior Publication Data

US 2011/0155834 A1 Jun. 30, 2011

(30) Foreign Application Priority Data

Dec. 30, 2009 (TW) ..... 98145771 A

(51) Int. Cl.
*B02C 2/04* (2006.01)

(52) U.S. Cl. ..... 241/215

(58) Field of Classification Search ..... 241/207–216
See application file for complete search history.

(56) References Cited

U.S. PATENT DOCUMENTS 1,717,894 A * 6/1929 Rumpel ..... 241/214
4,666,092 A * 5/1987 Bremer ..... 241/214

* cited by examiner

*Primary Examiner* — Mark Rosenbaum
(74) *Attorney, Agent, or Firm* — patenttm.us

(57) ABSTRACT

A vibrating cone crusher is capable of crushing rigid raw materials such as rocks and has a base, a bowl assembly, a transmission assembly, an inertial transmission mechanism and a head assembly. The bowl assembly is capable of vibrating and swaying. The head assembly is capable of rotating eccentrically. When operating, the vibrating or swaying bowl assembly cooperates with the eccentrically rotating head assembly to effectively crush raw materials that are installed in the vibrating cone crusher.

10 Claims, 6 Drawing Sheets

VIBRATING CONE CRUSHER

BACKGROUND OF THE INVENTION

1. Field of the Invention

The present invention relates to a crusher, and more particularly to a vibrating cone crusher that has a base, a bowl, a head. The bowl is capable of vibrating relative to the base. The head is capable of inertially moving relative to the base. Therefore, the vibrating cone crusher pounds, squeezes and crushes the raw materials such as larger rocks and causes smaller and harder rocks or gravels to crush bigger and softer rocks so that the all rocks are efficiently crushed into smaller gravels, or rock dust.

2. Description of Related Art

A conventional crusher has a base, a bowl, a transmission device and a head. The base has a top end and a bottom. The bowl is mounted on the top end of the base and has a cavity defined in the bowl and serving as a crush chamber. The crush chamber is hopper-shaped and has a top opening serving as an inlet for raw materials. The transmission device is mounted on the bottom of the base and has a vertical transmission shaft and a driving shaft. The driving shaft is mounted horizontally through the base and is connected rotatably to and selectively rotates the transmission shaft. The head is mounted on the transmission shaft and is capable of rotating eccentrically (also called roll-pressing) in the crushing chamber of the bowl. An inner surface of the crushing chamber of the bowl and an outer surface of the head cooperate to constitute an internal space for receiving raw materials such as rocks. When the transmission shaft rotates, the head eccentrically swivels so that the raw materials are crushed by the bowl and head into smaller particles.

The main operation of the aforementioned crusher is crushing raw materials by changing the configuration of the inner space between the inner surface of the crushing chamber of the bowl and the outer surface of the head through the eccentric motion of the head. The steps of crushing operation of the conventional crushers are material installing, roll-pressing, crushing and discharging.

According to the modern chorusing theory, the crushing procedure needs to change the positions of the particles of raw materials constantly to make particles to fully bear the shearing force. Among particles with same strength, particles having the lattice defects aligning the directions of shear forces are crushed. During the crushing procedure of the crusher, the particles of the raw materials are squeezed one another. An additional pressing force exerted to the particles of raw materials during the crushing procedure makes the particles close up compactly and crush one another to achieve the goal of "material layer comminution". The definition of "material layer comminution" is that a smaller particle has fewer lattice defects and has higher structural strength so that smaller particles can be used to crush and comminute larger particles that having comparatively lower structural strength. In such way, the raw materials are crushed along the areas between lattices of particles instead of breaking the entire lattices of the particles. Therefore, the crushed raw materials have minimum "over-crushing degree". The crusher may easily crush the raw materials having compressive strength of 200 to 300 Mpa.

The first crusher is designed by Symons brothers in U.S. however the first invented crusher cannot satisfy the modern crushing theory. Later developed HP crusher, inertial crusher and vibrating crusher all use the stationary bowl and eccentrically rotating head. The aforementioned conventional crushers have the following disadvantages.

1. The bowl is stationary relative to the base and only the head is rotatable to crush raw materials so that the crushing procedure is inefficient and cannot satisfy the modern crushing theory. The energy wasting and cost are high.

2. the transmission device has a vertical shaft engaged with a horizontal shaft by bevel gears and the horizontal shaft extends out of the base. The structure of the transmission is complicated so that the power loss thereof is high.

3. During the crushing procedure, over hard raw materials are easily stuck between the bowl and the head so that the head and transmission device are stopped and locked suddenly to make the crusher break down. Although all the crushers have safety releasing devices for releasing the inadvertently locked head or transmission device, the suddenly locked conditions already damage the crusher.

To overcome the shortcomings, the present invention provides a vibrating cone crusher to mitigate or obviate the aforementioned problems.

SUMMARY OF THE INVENTION

The main objective of the invention is to provide a vibrating cone crusher that has a base, a bowl, a head. The bowl is capable of vibrating relative to the base. The head is capable of inertially moving relative to the base. Therefore, the vibrating cone crusher pounds, squeezes and crushes the raw materials such as larger rocks and causes smaller and harder rocks or gravels to crush bigger and softer rocks so that the all rocks are efficiently crushed into smaller gravels, or rock dust.

A vibrating cone crusher in accordance with the present invention is capable of crushing rigid raw materials such as rocks and comprises a base, a bowl assembly, a transmission assembly, an inertial transmission mechanism and a head assembly. The bowl assembly is capable of vibrating and swaying. The head assembly is capable of rotating eccentrically. When operating, the vibrating or swaying bowl assembly cooperates with the eccentrically rotating head assembly to effectively crush raw materials that are installed in the vibrating cone crusher.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
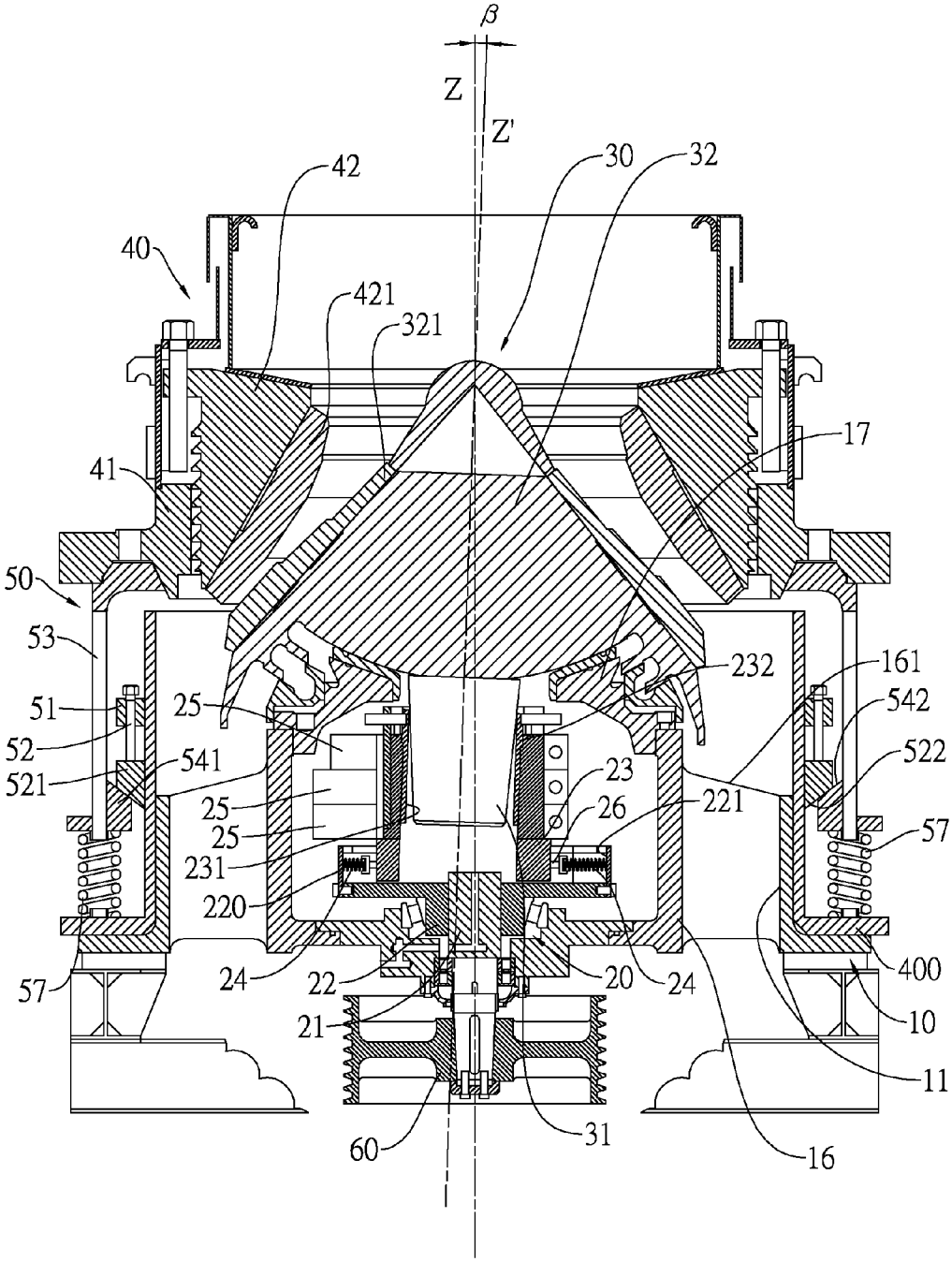
FIG. 1 is a cross sectional side view of a vibrating cone crusher in accordance with the present invention.
Figure 2:
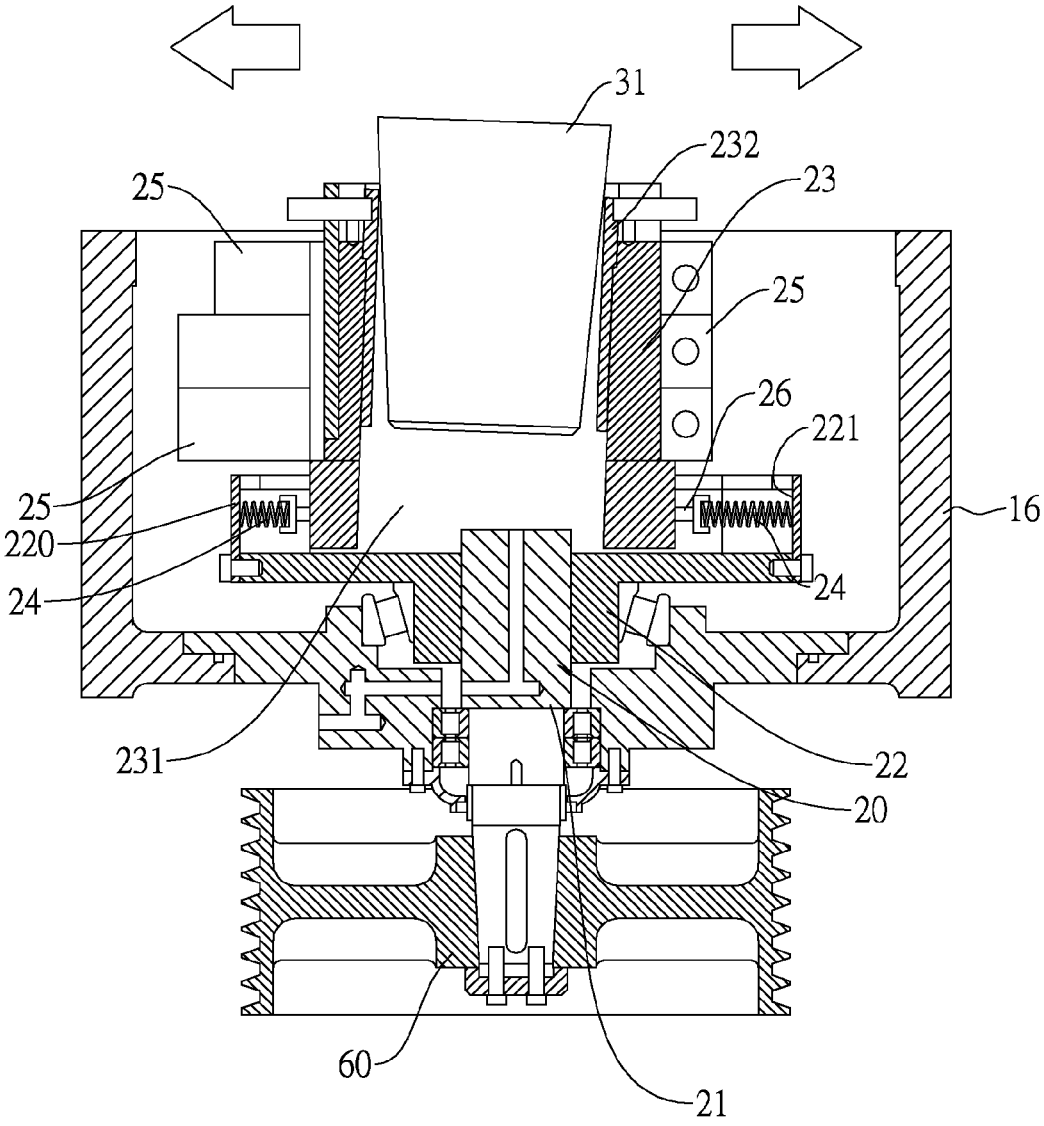
FIG. 2 is an enlarged cross sectional side view of the vibrating cone crusher in FIG. 1.
Figure 3:
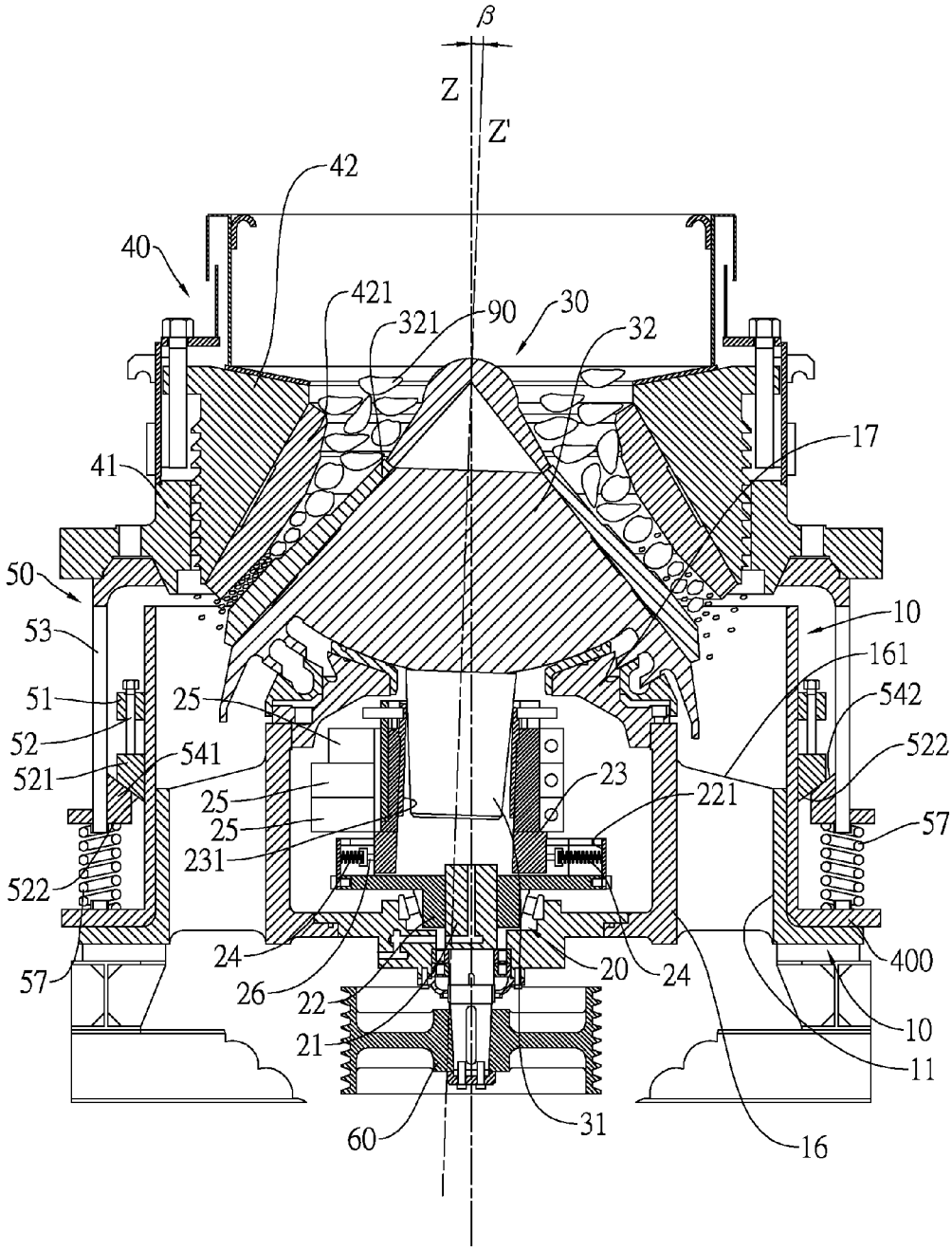
FIG. 3 is an operational cross side view of the vibrating cone crusher in FIG. 1 showing that the raw materials are installed in a crushing chamber thereof.

With reference to FIGS. 1 to 3, a vibrating cone crusher in accordance with the accordance with the present invention is capable of crushing rigid raw materials such as rocks and comprises a base (10), a bowl assembly (40), a transmission assembly, an inertial transmission mechanism (20), a head assembly (30) and a swaying mechanism (50).

The base (10) is cylindrical and has a cavity (11), an inner mounting bracket (16) and a ball bearing (17).

The cavity (11) is defined in the base (10) and has an inner surface.

The inner mounting bracket (16) is cylindrical, is formed in the cavity (11) and has a top and multiple ribs (161). The ribs (161) are formed on and protrude radially outward from the inner mounting bracket (16) and are connected to the inner surface of the cavity (11).

The ball bearing (17) is mounted on the top of the inner mounting bracket (16) and has a concave spherical surface.

Figure 4:
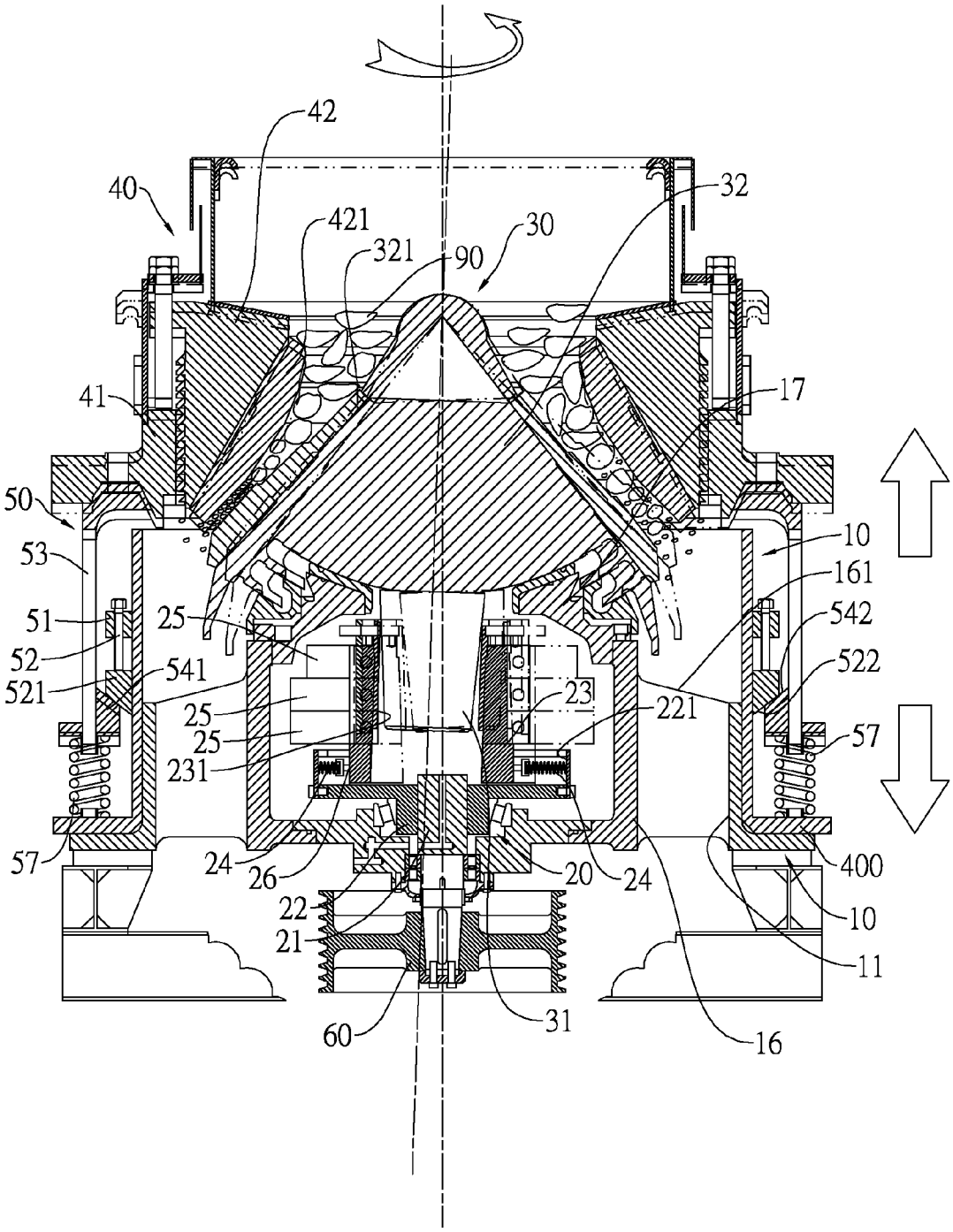
FIG. 4 is an operational cross side view of the vibrating cone crusher in FIG. 3 showing that the raw materials are crushed by the eccentrically rotating head and the vibrating bowl.

With further reference to FIG. 4, the bowl assembly (40) is mounted on the base (10) and is capable of vertically vibrating and three-dimensionally swaying relatively to the base (10). The swaying motion is like twisting a stick of a joystick around a vertical axis. The bowl assembly has a seat (400), an upper mounting bracket (41) and a bowl (42).

The seat (400) is annular and is mounted around the base (10) and may be mounted securely on the base (10) through fasteners such as bolts.

The upper mounting bracket (41) is annular and is mounted on the seat (400).

The bowl (42) is annular and is mounted on the upper mounting bracket (41) and has a crushing chamber (43). The crushing chamber (43) is defined through the bowl (42) and has an inner surface and a bowl liner (421). The bowl liner (421) is annular and replaceable, is made of wear-proof material and is mounted on the inner surface of the crushing chamber (43).

The transmission assembly is mounted rotatably on the inner mounting bracket (16) in the cavity (11) and has a transmission shaft (21) and a driving pulley (60).

The transmission shaft (21) is mounted vertically and rotatably in the cavity (11) of the base (10), may be rotatably mounted through the inner mounting bracket (16), is capable of rotating around the vertical axis and has a top end and a bottom end.

The driving pulley (60) is mounted securely around the bottom end of the transmission shaft (21) in the cavity (11) of the base (10) and is capable of rotating with the transmission shaft (21) around the vertical axis. A belt on a motor may be mounted around the driving pulley (60) so that moving the belt rotates both the driving pulley (60) and the transmission shaft (21). The belt is replaced easily after worn and damaged. Furthermore, the belt is made of resilient or soft material so does not wear or damage the driving pulley (60) that is generally made of metal.

The inertial transmission mechanism (20) is mounted on the transmission assembly and has a coupling (22), a positioning member (220), an eccentric sleeve (23), at least one spring (24) and at least one guiding pin (26).

The coupling (22) is mounted on the top end of the transmission shaft (21).

The positioning member (220) is formed on the coupling (22) and has a linear sliding slot (221) defined in the positioning member (220) and having an inner surface.

The eccentric sleeve (23) is hollow, is mounted slidably in the linear sliding slot (221) of the positioning member (220) and is capable of implementing simple harmonic motion (SHM). The eccentric sleeve (23) has an eccentric hole (231) and multiple eccentric weights (25). The eccentric hole (231) is defined in the eccentric sleeve (23) and is located eccentrically relative to the transmission shaft (21). Particularly, an axis of the eccentric hole (231) departs from and misaligns an axis (Z) of the transmission shaft (21) and may be inclined. The eccentric weights (25) are mounted detachably around the eccentric sleeve (25) to further control a deviation of a total center of gravity of the eccentric sleeve (23) and the eccentric weights (25) from the axis (Z) of the transmission shaft (21) so that a centrifugal force generated by the rotating eccentric sleeve (23) at a specific rpm is adjusted. Changes the centrifugal force helps to increase or decrease a crushing force of the later discussed head assembly (30) to raw materials (90). The centrifugal force can be adjusted by increasing or reducing the eccentric weights (25).

The aforementioned centrifugal force from the eccentric weight (25) ensures the eccentric sleeve (23) at a specific radial location relative to the transmission shaft (21).

The at least one first spring (24) is mounted in the inner surface of the linear sliding slot (221) of the positioning member (220) and presses against the eccentric sleeve (23).

The at least one guiding pin (26) is mounted in the linear sliding slot (221), is connected respectively in the at least one first spring (24) and abuts the eccentric sleeve (23). Therefore the at least one first spring (24) keeps eccentric sleeve (23) at a predetermined position. Preferably, two first springs (24) are diametrically opposite to each other. Two guiding pins (26) are mounted respectively to the two springs (24).

The head assembly (30) is mounted on the eccentric sleeve (23) and is located eccentrically relative to the transmission shaft (21) so that an axis of the head assembly (30) departs from the axis (Z) of the transmission shaft (21). The head assembly (30) has a connecting shaft (31) and a head (32).

The connecting shaft (31) is mounted in the eccentric hole (231) of the eccentric sleeve (23). An axis (Z') of the connecting shaft (31) may be inclined relative to the axis (Z) of the transmission shaft (21) so that an included angle ($\beta$) is defined between the axes (Z, Z'). Furthermore, the connecting shaft (31) is detachably attached to the eccentric sleeve (23) without fasteners instead of being rigidly connected to the eccentric sleeve (23).

The head (32) is conical, is formed on the connecting shaft (31), is held rotatably by the ball bearing (17) of the inner mounting bracket (16) of the base (10), is located eccentrically relative to the axis (Z) of the transmission shaft (21) and is capable of rotating eccentrically to crush the raw materials (90) poured in the crushing chamber (43). Furthermore, an axis of the head (32) is substantially same as the axis (Z') of the connecting shaft (31) and the axis of the head assembly (30). When the raw materials (90) are over hard and jammed between the bowl (42) and the head (32), the transmission assembly stops rotating suddenly and the centrifugal force reduces and vanishes to move the eccentric sleeve (23) and the head assembly (32) along the linear sliding slot (221) of the positioning member (220). Therefore, the head (32) is shifted to release the raw materials (90) and prevent the vibrating cone crusher from breaking down.

The head (32) has a spherical bottom surface, an outer surface and a head liner (321). The spherical bottom surface rotatably contacts the spherical surface of the ball bearing (17). The head liner (321) is replaceable, is made of wear-proof material and is mounted on the inner surface of the crushing chamber (43).

The swaying mechanism (50) is connected to the seat (400) and the upper mounting bracket (41), selectively sways the bowl assembly (40) relative to the base (10) and the head assembly (30) and has a limiting ring (51), multiple adjustment bolts (52), a supporting bracket (53), a first sliding member (521), a second sliding member (541) and multiple second springs (57).

The limiting ring (51) is annular, is mounted securely around the seat (400) and has multiple through holes defined through the limiting ring (51).

The adjustment bolts (52) are mounted respectively through the through holes of the limiting ring (51) and may be arranged around the seat (400). Each adjustment bolt (52) has a bottom end.

The supporting bracket (53) is annular and is connected securely to the upper mounting bracket (41) of the bowl assembly (40).

The first sliding member (521) is annular, is mounted on the bottom ends of the adjustment bolts (52) and has a spherical bottom surface (522).

The second sliding member (541) is annular, is mounted on the supporting bracket (53), contacts the first sliding member (522) and has a spherical top surface (542) movably contacting the spherical bottom surface of the first sliding member (521). The contact of the first and second sliding members (521, 541) facilitates the bowl assembly (40) swaying relative to the base (10) and the head assembly (30).

The second springs (57) are mounted between the seat (400) and the second sliding member (541) and biases the second sliding member (541) against the first sliding member (521).

The following descriptions are relevant to the operation of the vibrating cone crusher.

1. The Operating of the Vibrating Cone Crusher:

2. The raw materials (90) between the rotating head assembly (30) and bowl assembly (40) make the bowl assembly (30) vibrating and sway. The eccentrically rotating head assembly (40) including complex motions of precession and spin cooperates with the bowl assembly (30) to effectively crush the raw materials (90).

When the vibrating cone crusher operates, an external motor drives the driving pulley (60) and the transmission shaft (21) to rotate. The eccentric sleeve (23) and the head assembly (30) rotate eccentrically. At the same time the eccentric sleeve (23) and the head assembly (30) slide in the linear sliding slot (221) due to the centrifugal force. The squeezed raw materials (90) and vibrate and sway the bowl assembly (40). The vibrating and swaying bowl assembly (40) cooperate with the eccentrically rotating head assembly (30) to effectively crush the raw materials (90).

Figure 5:
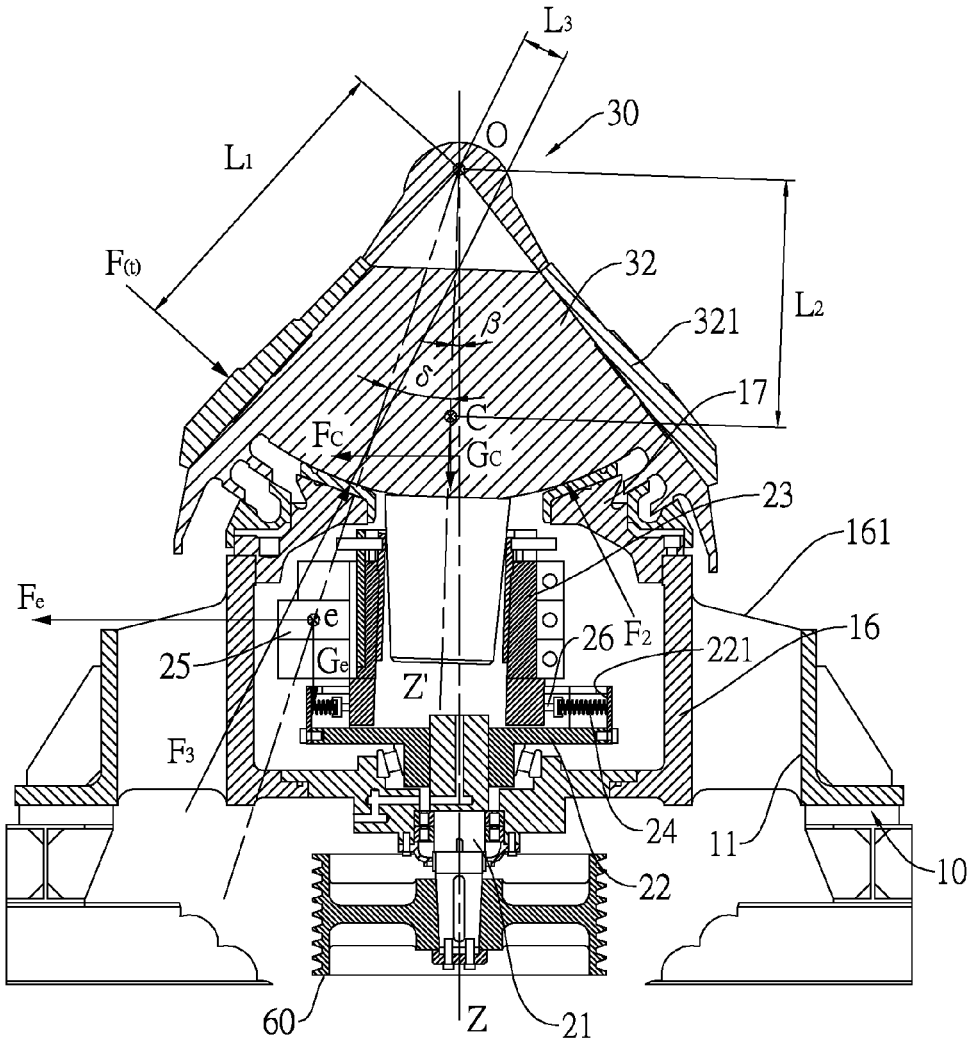
FIG. 5 is a cross sectional side view of the vibrating cone crusher in FIG. 1 omitting the bowl.
Figure 6:
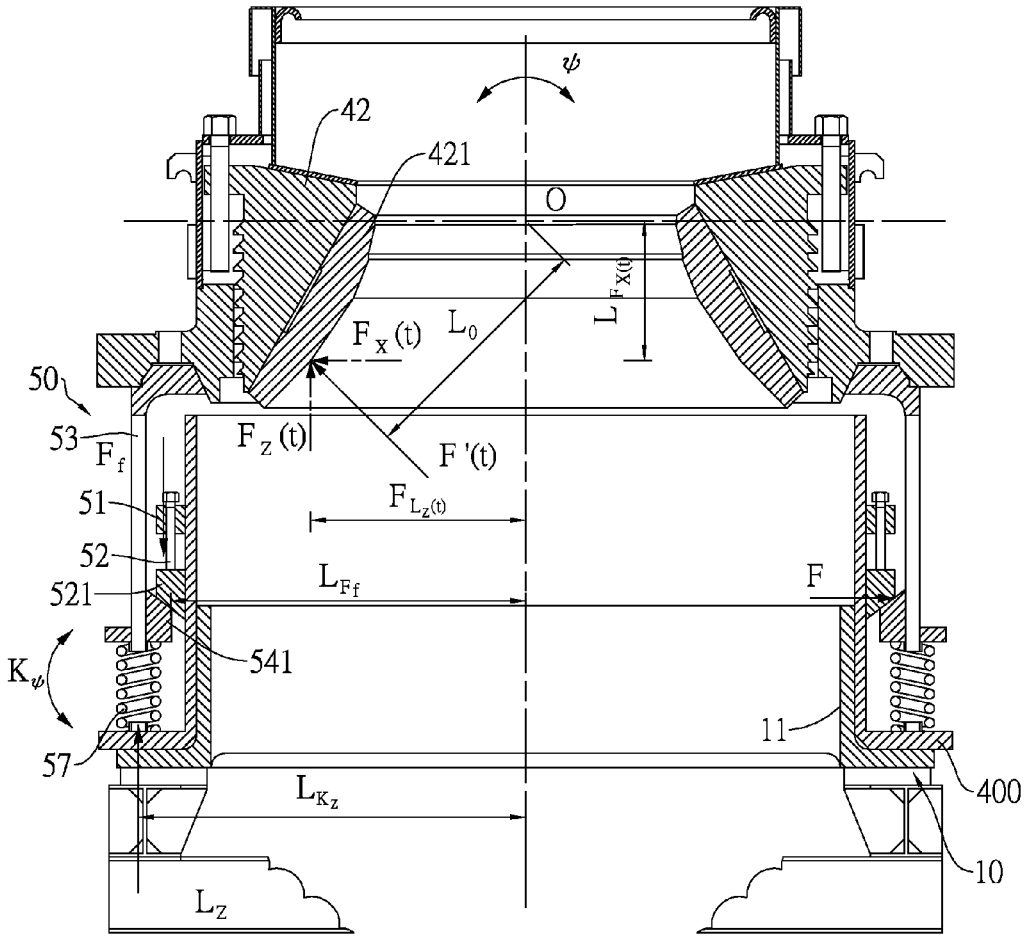
FIG. 6 is a cross sectional side view of the base and the bowl of the vibrating cone crusher in FIG. 1.

With further reference to FIGS. 5 and 6, the following descriptions explain the mechanics model of the vibrating cone crusher.

The crushing force F(t) and the center of circle (O) are at a distance ($L_1$). The center of mass (C) of the head assembly (30) and the center of circle (O) are at a distance ($L_2$). The center of mass (C) has a gravity ($G_c$). The inertial force ($F_c$) is vertical to the axis ($\overline{OZ}$). The center of mass (e) of the eccentric weights (25) and the center of circle (O) are at a distance ($L_e$). The center of mass (e) has a gravity ($G_e$) and an inertial force ($F_e$). A line between the center of mass (e) and the center of circle (O) and the axis ($\overline{OZ'}$) have an included angle (δ). The axes ($\overline{OZ'}$, $\overline{OZ}$) have an included angle (β). A force ($F_2$) of the ball bearing (17) acts on the head assembly (30) and is at a distance ($L_2$) from the center of circle (O). A force ($F_3$) of the eccentric weights (25) acts on the head assembly (30). According to the principle of force equilibrium, relation of the crushing force F(t) and inertial force ($F_e$) can be figured out.

With reference to FIG. 6, according to the conditions of a rigid body equilibrium, the force or moment applied on the body is zero, ρFx,y,z(t)=0, ρMx,y,z(t)=0. When Mx,y,z(t)≠0, a rotation happens around the center of circle (O). The first spring (24) is a key factor to control the rotation, the coefficient of elasticity ($k_Z$,$k_\Psi$) effects the F'(t)、M(t). $k_\Psi$=M(t), the angle (Ψ) is decided by coefficient of the elasticity and the moment. The following differential equations show a simplified vibrating system of the vibrating cone crusher in accordance the present invention.

$$\left.\begin{aligned} m\bar{x}'' + C\bar{x}' + k_z\bar{x} &= F'(t) \\ J\bar{\psi}'' + C_\psi\bar{\psi}' + k_\psi\bar{\psi} &= M(t) \end{aligned}\right\}, \tag{1}$$

wherein $\overline{X}$=X+iy; $\overline{\Psi}=\Psi_{oy}+\Psi_{ox}$

The relation of the crushing force F(t), F'(t) is from the crushed raw materials (90). Because the particles of the raw materials (90) are different and irregular and are not distributed uniformly in the crushing chamber (43) so that F'(t) changes irregularly and cannot completely described by mathematic equations.

2. The Operation of the Swaying Mechanism (50):

The present invention employs the operation of a joystick and the SHM to sway the bowl assembly (40) and satisfies the modern crushing theory to completely crush the raw materials (90). The adjustment bolts (52) may be adjusted to control the height of the first sliding member (521) to change the swaying strength of the bowl assembly (40).

3. The Operation of the Inertial Transmission Mechanism (20):

When the transmission shaft (21) rotates, the asymmetrical eccentric sleeve (23) and eccentric weights (25) rotate eccentrically and generate a centrifugal force to slide the eccentric sleeve (23), eccentric weights (25) and the head assembly (30) along the linear sliding slot (221) of the positioning member (220). The first spring (24) is compressed to provide a resilient force against the centrifugal force so that the eccentric sleeve (23), eccentric weights (25) and the head assembly (30) are balanced and positioned at a specific position. When the inertia force F(t) is larger than the crushing force F'(t), the balance condition is kept. On the contrary, when the inertia force F(t) is smaller than the crushing force F'(t), the first spring (24) pushes and releases the eccentric sleeve (23). The eccentric sleeve (23) slides reciprocally in the linear sliding slot (221) according the rotational frequency of the transmission shaft (21). Therefore, the raw materials (90) in the crushing chamber (43) are not jammed and not break down the vibrating cone crusher. The crushing force F(t) can be adjusted by changing the included angle (β) of the axes ($\overline{OZ'}$, $\overline{OZ}$).

The vibrating cone crusher has the following advantages.

1. The present invention has great "material layer comminution" effect. The crushing chamber (43) are filled with raw materials (90). The raw materials (90) fully suffer the shearing forces from all directions and the particles of the ram materials (90) crushes one another. Such crushing effect reduces the wear of the bowl liner (421) and head liner (321). Therefore, the present invention can conduct with crushing, squeezing and compacting procedures.

2. The crushing ratio of the present invention is larger than conventional crushers so that the adjusting the crushing ratio from 4 to 12 is easy. The materials with different hardness may be easily crushed.

3. Because the head (32) and the eccentric sleeve (13) is not rigidly connected to the transmission shaft (21), the jammed uncrushed raw materials do not deadly lock the head assembly (30) and also not break down the vibrating cone crusher.

4. The driving pulley (60) is mounted securely to the transmission shaft (21) in the cavity (11) of the base (10) and is connected to a resilient or soft belt instead of engaging rigid component so will not wear easily. Therefore, the maintenance cost is reduced.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A vibrating cone crusher comprising:

a base being cylindrical and having a cavity defined in the base;

an inner mounting bracket being cylindrical, formed in the cavity and having a top; and a ball bearing mounted on the top of the inner mounting bracket;

a bowl assembly mounted on the base and being capable of vertically vibrating and three-dimensionally swaying relatively to the base;

a transmission assembly mounted rotatably on the inner mounting bracket in the cavity and having a transmission shaft mounted vertically and rotatably in the cavity of the base and having a top end; and a driving pulley mounted securely around the transmission shaft in the cavity of the base;

an inertial transmission mechanism mounted on the transmission assembly; and a head assembly mounted on an eccentric sleeve and located eccentrically relative to the transmission shaft so that an axis of the head assembly departs from an axis of the transmission shaft.

2. The vibrating cone crusher as claimed in claim 1, wherein the bowl assembly has a seat being annular and mounted around the base;

an upper mounting bracket being annular and mounted on the seat; and a bowl being annular and mounted on the upper mounting bracket and having a crushing chamber defined through the bowl and having an inner surface;

the inertial transmission mechanism has a coupling mounted on the top end of the transmission shaft;

a positioning member formed on the coupling;

at least one first spring mounted in the positioning member and pressing against the eccentric sleeve; and the eccentric sleeve being hollow, mounted slidably in the positioning member and being capable of implementing simple harmonic motion (SHM);

the head assembly has a connecting shaft mounted in the eccentric sleeve; and a head being conical, formed on the connecting shaft and held rotatably by the ball bearing of the inner mounting bracket of the base.

3. The vibrating cone crusher as claimed in claim 2, wherein the eccentric sleeve further has at least one eccentric weight mounted detachably around the eccentric sleeve.

4. The vibrating cone crusher as claimed in claim 3, wherein the axis of the head assembly is inclined to the axis of the transmission shaft so that an inclined angle is defined between the axes of the head assembly and the transmission shaft.

5. The vibrating cone crusher as claimed in claim 4, wherein the positioning member has a linear sliding slot defined in the positioning member and having an inner surface;

the eccentric sleeve is mounted slidably in the linear sliding slot;

two first springs are mounted in the inner surface of the linear sliding slot.

6. The vibrating cone crusher as claimed in claim 5, wherein the eccentric sleeve has an eccentric hole defined in the eccentric sleeve and located eccentrically relative to the transmission shaft; and the connecting shaft of the head assembly is mounted in the eccentric hole.

7. The vibrating cone crusher as claimed in claim 6 further comprising a swaying mechanism connected to the seat and the upper mounting bracket, selectively swaying the bowl assembly relative to the base and the head assembly.

8. The vibrating cone crusher as claimed in claim 7, wherein the swaying mechanism has a limiting ring being annular, mounted securely around the seat and having multiple through holes defined through the limiting ring;

multiple adjustment bolts mounted respectively through the through holes of the limiting ring and each adjustment bolt having a bottom end;

a supporting bracket being annular and connected securely to the upper mounting bracket of the bowl assembly;

a first sliding member being annular and mounted on the bottom ends of the adjustment bolts;

a second sliding member being annular and mounted on the supporting bracket, contacting the first sliding member;

multiple second springs mounted between the seat and the second sliding member and biasing the second sliding member against the first sliding member.

9. The vibrating cone crusher as claimed in claim 8, wherein the first sliding member has a spherical bottom surface; and the second sliding member has a spherical top surface movably contacting the spherical bottom surface of the first sliding member.

10. The vibrating cone crusher as claimed in claim 1, wherein the transmission shaft is rotatably mounted through the inner mounting bracket.

* * * * *